US007995961B2

(12) United States Patent
Ichiki et al.

(10) Patent No.: US 7,995,961 B2
(45) Date of Patent: Aug. 9, 2011

(54) WASTE DEVELOPER COLLECTING DEVICE AND IMAGE FORMING APPARATUS

(75) Inventors: Yukihiro Ichiki, Ebina (JP); Junichiro Sameshima, Ebina (JP); Shigeru Tanaka, Ebina (JP); Tomokazu Kurita, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 631 days.

(21) Appl. No.: 12/127,528

(22) Filed: May 27, 2008

(65) Prior Publication Data

US 2009/0123189 A1 May 14, 2009

(30) Foreign Application Priority Data

Nov. 14, 2007 (JP) ..... 2007-295336

(51) Int. Cl.
*G03G 15/08* (2006.01)
*G03G 21/12* (2006.01)

(52) U.S. Cl. ..... 399/360; 399/120; 399/257

(58) Field of Classification Search ..... 399/120, 399/257, 358, 360
See application file for complete search history.

(56) References Cited

U.S. PATENT DOCUMENTS

| | | | | |
|---|---|---|---|---|
| 5,414,499 | A * | 5/1995 | Yahata | 399/106 |
| 5,499,090 | A * | 3/1996 | Ito et al. | 399/359 |
| 5,508,794 | A * | 4/1996 | Ikesue et al. | 399/120 |

FOREIGN PATENT DOCUMENTS

| | | | |
|---|---|---|---|
| JP | 11-3015 | A | 1/1999 |
| JP | 2003-15420 | A | 1/2003 |
| JP | 2005-331611 | A | 12/2005 |
| JP | 2006-258860 | A | 9/2006 |

* cited by examiner

*Primary Examiner* — David M Gray
*Assistant Examiner* — Joseph S Wong
(74) *Attorney, Agent, or Firm* — Sughrue Mion, PLLC

(57) ABSTRACT

A waste developer collecting device comprising: a collecting container; a collecting opening; a conveying unit; a filter; a partition wall; and an air inlet.

13 Claims, 15 Drawing Sheets

WASTE DEVELOPER COLLECTING DEVICE AND IMAGE FORMING APPARATUS

CROSS-REFERENCE TO RELATED APPLICATIONS

This application is based on and claims priority under 35 U.S.C. 119 from Japanese Patent Application No. 2007-295336 filed Nov. 14, 2007.

BACKGROUND

Technical Field

The present invention relates to a waste developer collecting device for collecting a waste developer discharged from an image forming device and the image forming apparatus using the same.

SUMMARY

According to a first aspect of the present invention, a waste developer collecting device includes: a collecting container that collects a waste developer discharged from image forming unit including a developing unit for developing an electrostatic latent image with a developer; a collecting opening that is disposed on an inner wall surface of the collecting container, and collects the waste developer and air discharged from the developing unit; a conveying unit that is disposed in the collecting container, rotates about a shaft, and conveys the waste developer entering through the collecting opening in the collecting container; a filter that passes the air collected in the collecting container through the collecting opening, and blocks the waste developer; a partition wall that partitions an inside of the collecting container into the filter and a containing area for containing the waste developer; and an air inlet that is formed in an end portion of the partition wall on an upstream side in a conveying direction of the waste developer conveyed by the conveying unit, and that sends the air entering into the collecting container to the filter along the partition wall.

BRIEF DESCRIPTION OF THE DRAWINGS

Exemplary embodiment of the present invention will be described in detail based on the following figures, wherein.

DETAILED DESCRIPTION

Figure 1:
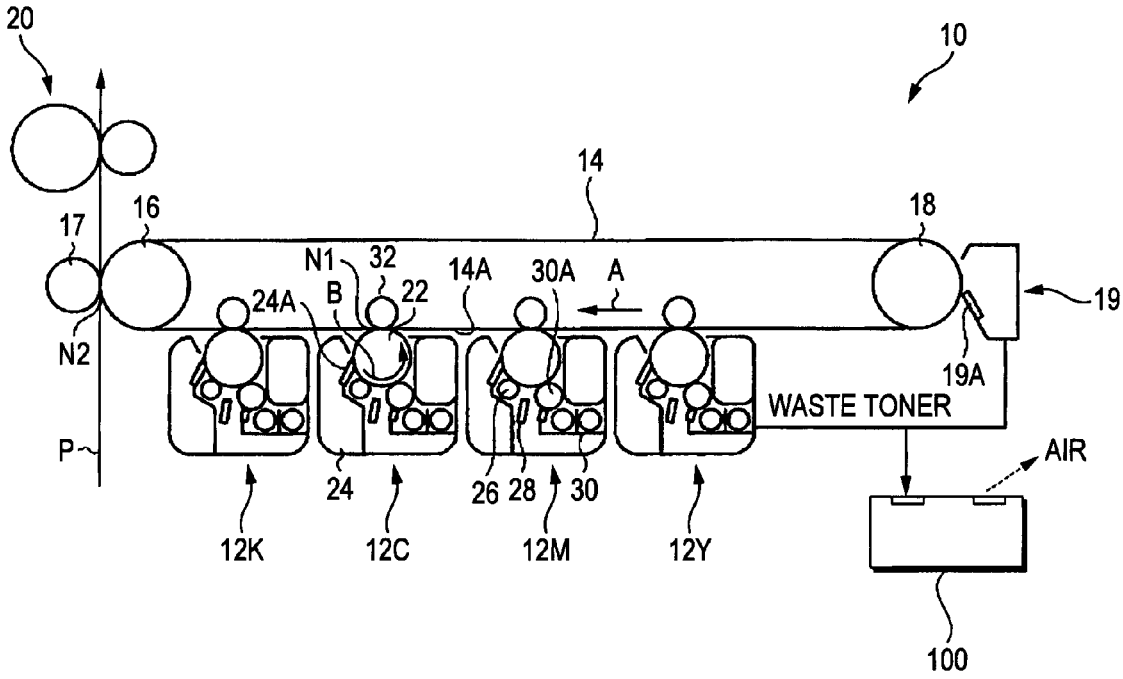
FIG. 1 is a schematic view illustrating a configuration of the image forming apparatus according to an embodiment.

Hereinafter, embodiments of the invention will be described with reference to the drawing. The invention relates to a waste developer collecting device for collecting a waste developer discharged from image forming means including a developing unit for developing an image with a developer and the image forming apparatus using the same. Examples of the image forming means includes a photoreceptor integrally unit formed of a photoreceptor, a charger, and a cleaning, and an image forming unit formed of an exposure unit, a developing unit, and a transfer unit. In addition, the waste developer to be collected is regarded as a waste developer discharged from the developing unit, a waste toner removed from a photoreceptor, or both of the waste developer and the waste toner. An image forming apparatus of the invention includes a waste developer collecting device of the invention characterized in the following description.

(Image Forming Apparatus)

FIG. 1 is a schematic view illustrating a configuration of the image forming apparatus according to an embodiment. As shown in FIG. 1, an image forming apparatus 10 performs full-color printing or copying with toners of yellow (Y), magenta (M), cyan (C), and black (K). In addition, the image forming apparatus 10 is a so called tandem type printer in which print engines 12Y, 12M, 12C, and 12K (hereinafter, it is referred to as 12Y to 12K) using the toners of Y, M, C, and K are arranged along a flat surface 14A of the lower side of the intermediate transfer belt 14. The print engines 12Y to 12K sequentially transfer and superpose the toner images of Y to K on an intermediate transfer belt 14 while the intermediate transfer belt 14 makes one rotation, thereby forming a full-color toner image.

The intermediate transfer belt 14 is tensioned in a horizontal direction by rollers 16 and 18, and is rotated in an arrow A direction (a clockwise direction) shown in the drawing. The roller 16 is disposed on a downstream side in the arrow A direction than the print engines 12Y to 12K. The roller 16 directly contacts with a secondary transfer roller 17 formed on an outer peripheral side of the intermediate transfer belt 14 with an intermediate transfer belt 14 interposed therebetween. The roller 16 and the secondary transfer roller 17 form a secondary transfer nip N2. To the secondary transfer nip N2, a recording sheet P is fed through a sheet path not shown in the drawing, and simultaneously a transfer bias is applied to the secondary transfer roller 17. Thereby, a full-color toner image formed on the intermediate transfer belt 14 is transferred on a recording sheet P.

In addition, the roller 18 is disposed on an upstream side in the arrow A direction than the print engines 12Y to 12K. The roller 18 directly contacts with a cleaner blade 19A of a cleaner unit 19 formed on the outer peripheral side of the intermediate transfer belt 14 with the intermediate transfer belt 14 interposed therebetween. The cleaner blade 19A cleans the intermediate transfer belt 14 by scraping off the toner that is not transferred to the recording sheet P and remains in the intermediate transfer belt 14.

In addition, in a downstream side of the secondary transfer nip N2 in a conveying direction, a fixing unit 20 is formed. The fixing unit 20 fixes the toner of the recording sheet P onto the recording sheet P by heating and pressing the toner when the recording sheet P passes through the fixing unit 20. Then, the recording sheet P is ejected from the image forming apparatus 10.

Next, the print engines 12Y to 12K will be described. Each of the print engines 12Y to 12K includes a photoreceptor 22, a cleaner unit 24 sequentially disposed around the photoreceptor 22 in a rotational direction (the arrow B direction in the drawing) of the photoreceptor 22, a charging roller 26, an exposure head 28, and a developing unit 30. The photoreceptor 22 directly contacts with the outer peripheral side of the flat surface 14A of the intermediate transfer belt 14. The photoreceptor 22 directly contacts with a primary transfer roller 32 formed on an inner peripheral side of the intermediate transfer belt 14 with the intermediate transfer belt 14 interposed therebetween. The photoreceptor 22 and the primary transfer roller 32 form a primary transfer nip N1.

Now, a print operation of the print engines 12Y to 12K will be described. First, by applying a charging bias having DC voltage and AC voltage superposed each other to the charging roller 26 rotating in contact with the photoreceptor 22, the photoreceptor 22 is uniformly charged. Next, a charged surface of the photoreceptor 22 is exposed by an exposure head 28 such as LED array, and so an electrostatic latent image is formed in accordance with image data.

Next, a developing bias is applied to a development roller 30A of the developing unit 30, and the toner adhered to the development roller 30A moves onto the electrostatic latent image of the photoreceptor 22. Thus, the electrostatic latent image of the photoreceptor 22 is developed. Furthermore, a transfer bias is applied to the primary transfer roller 32, and thus a toner image is transferred by the primary transfer nip N1 from the photoreceptor 22 to the intermediate transfer belt 14. Finally, a cleaner blade 24A of a cleaner unit 24 cleans a surface of the photoreceptor 22 by scraping off the toner that is not transferred to the intermediate transfer belt 14 and remains in the photoreceptor 22.

In addition, the waste developer, which includes the toner (waste toner) collected from the cleaner unit 19 of the intermediate transfer belt 11 and the cleaner unit 24 of the print engines 12Y to 12K and the developer (discharged developer) discharged from the and developing unit 30, is conveyed through a pipe not shown in the drawing to the waste developer collecting device 100 of the embodiment.

(Waste Developer Collecting Device)

Figure 2:
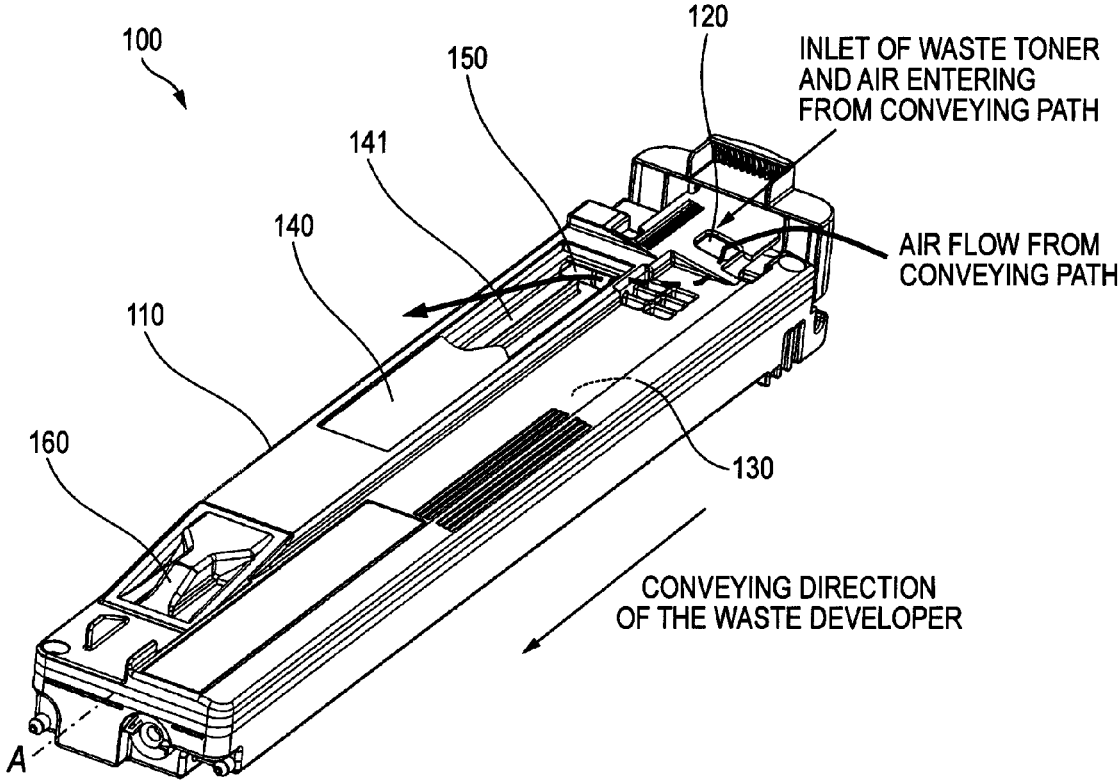
FIG. 2 is a perspective view illustrating a waste developer collecting device according to an embodiment.

FIG. 2 is a perspective view illustrating a waste developer collecting device according to an embodiment. Specifically, a waste developer collecting device 100 includes a collecting container (for example, a collecting box 110) for collecting the waste developer including the waste toner discharged from the cleaning unit 19 and the developer discharged from the developing unit 30, a collecting opening 120 serving as an inlet for the waste developer and air (air internally pressurized in the developing unit) formed on an upper surface of the collecting box 110, conveying means 130 for conveying frontward the waste developer entering through the collecting opening 120 one after another in the collecting box 110, and a filter 140 for passing only air entering through the collecting opening 120 to be discharged to the outside.

Particularly, the embodiment is characterized in the following respects. The collecting opening 120 is disposed at a position deviated from the center of the upper surface of the collecting box 110. The shaft of the conveying means 130 is disposed at a position deviated from the center to correspond to the collecting opening 120 inside the collecting box 110. The filter 140 is disposed on a position biased to an opposite side of the collecting opening 120 in the upper surface of the collecting box 110. The partition wall 141 is formed to partition the inside of the collecting box 110 into the filter 140 and the collecting area of the waste developer. The air inlet 150 is formed at an end portion of the partition wall 141 on an upstream side in the conveying direction of the waste developer conveyed by the conveying means 130 to send the air entering into the collecting box 110 to the filter 140 along the partition wall 141.

The collecting box 110 is formed in a substantially rectangular parallelepiped box shape. Into the collecting box 110, the air internally pressurized in the waste developer and a developing unit casing (not shown in the drawing) flows from the collecting opening 120 formed on the upper surface thereof.

The collecting opening 120 is disposed on the position (in an example shown in FIG. 2, the position is biased to the right side) deviated from the center line (the center line A in the drawing) along a lengthwise direction of the collecting box 110 in the end portion of the upper surface of the collecting box 110.

Figure 3:
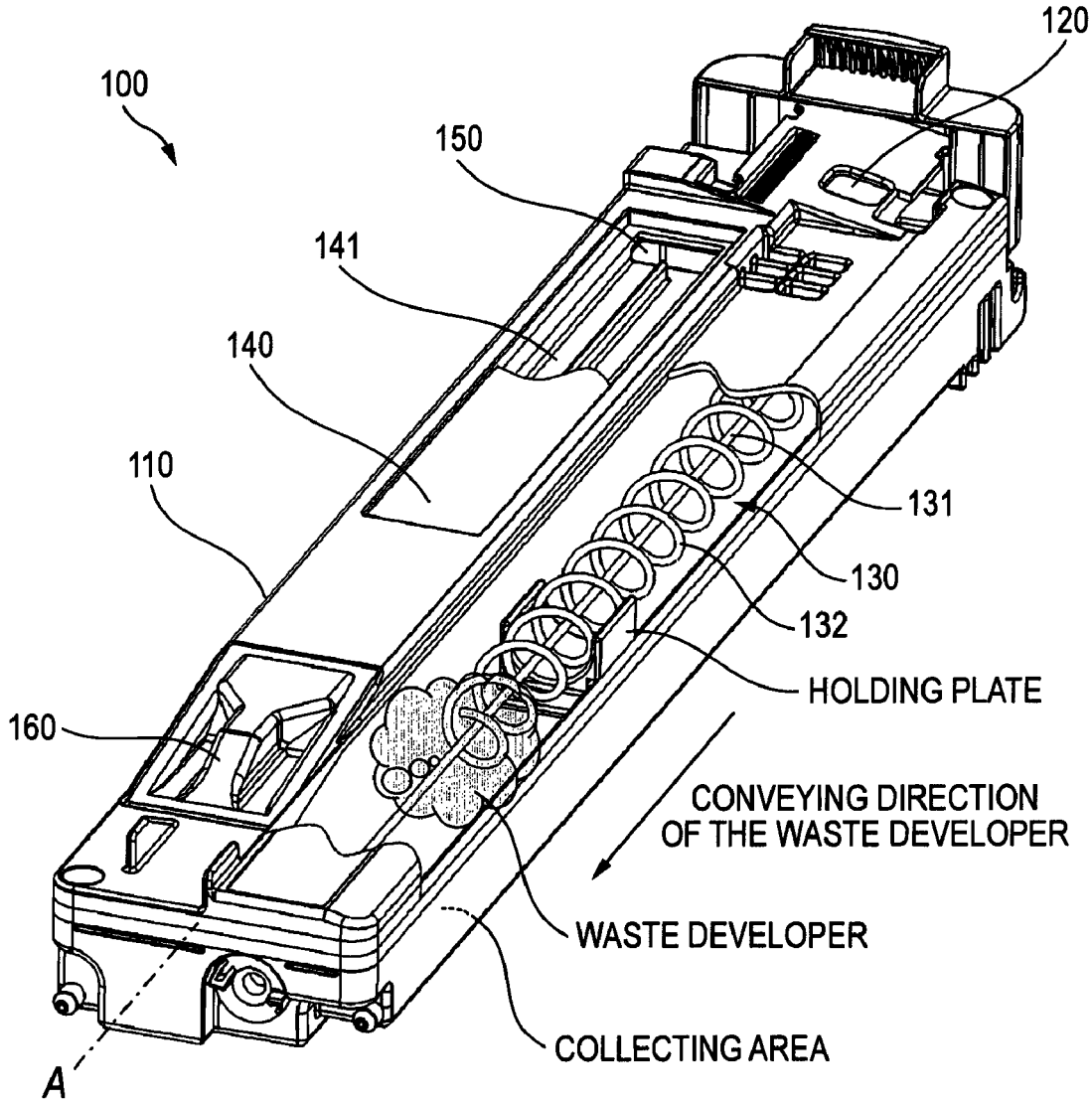
FIG. 3 is a partially cut-away perspective view illustrating an inside of the waste developer collecting device according to an embodiment.

In addition, the conveying means 130 is disposed at the position deviated from the center to correspond to the collecting opening 120 inside the collecting box 110. FIG. 3 is a partially cut-away perspective view illustrating the inside of the waste developer collecting device according to an embodiment. The conveying means 130 is formed of the shaft 131 formed along the lengthwise direction of the collecting box 110 and a coil 132 formed in a spiral shape around the shaft 131, and is configured to be able to send the waste developer one after another by using the coil 132 rotated with the shaft 131 by an external motor.

In the embodiment, the position of the shaft 131 of the conveying means 130 corresponds to the position of the collecting opening 120, and the waste developer entering into the collecting box 110 through the collecting opening 120 is directly dropped to the upper end portion of the conveying means 130 in the conveying direction. Then, the waste developer is sent one after another in the shaft direction by the rotation of the coil 132 of the conveying means 130, and then is pushed toward the end opposite to the collecting opening 120 in the collecting box 110. Then, the waste developer reached up to the terminal end of the coil 132 is radially spread from the terminal end in the collecting box 110 and is collected into the collecting area of a front end side of the collecting box 110.

Here, the waste developer is dropped into the collecting box 110 from the collecting opening 120 disposed on the biased position in the upper surface of the collecting box 110, and is sent frontward by the conveying means 130 disposed on the biased position similarly. Accordingly, the waste developer flows through the biased position (which is the right side of the center line A in examples shown in FIGS. 2 and 3) in the collecting box 110, and is collected while being radially spread from the terminal end of the coil 132.

On the other hand, the filter 140 is disposed on the biased position (which is the left side of the center line A in the examples shown in FIGS. 2 and 3) opposite to the collecting opening 120 in the upper surface of the collecting box 110. The filter 140 is inserted to an aperture formed on the upper surface of the collecting box 110, and is configured to collect dust such as the waste developer by passing the air entering into the collecting box 110.

In the embodiment, between the filter 40 and the collecting box 110, a partition wall 141 is formed. The partition wall 141 has a plate member that faces to the filter 140 with a small interspace interposed therebetween, and is formed to surround the filter 140 except for the air inlet 150 formed on one end portion.

Figure 4:
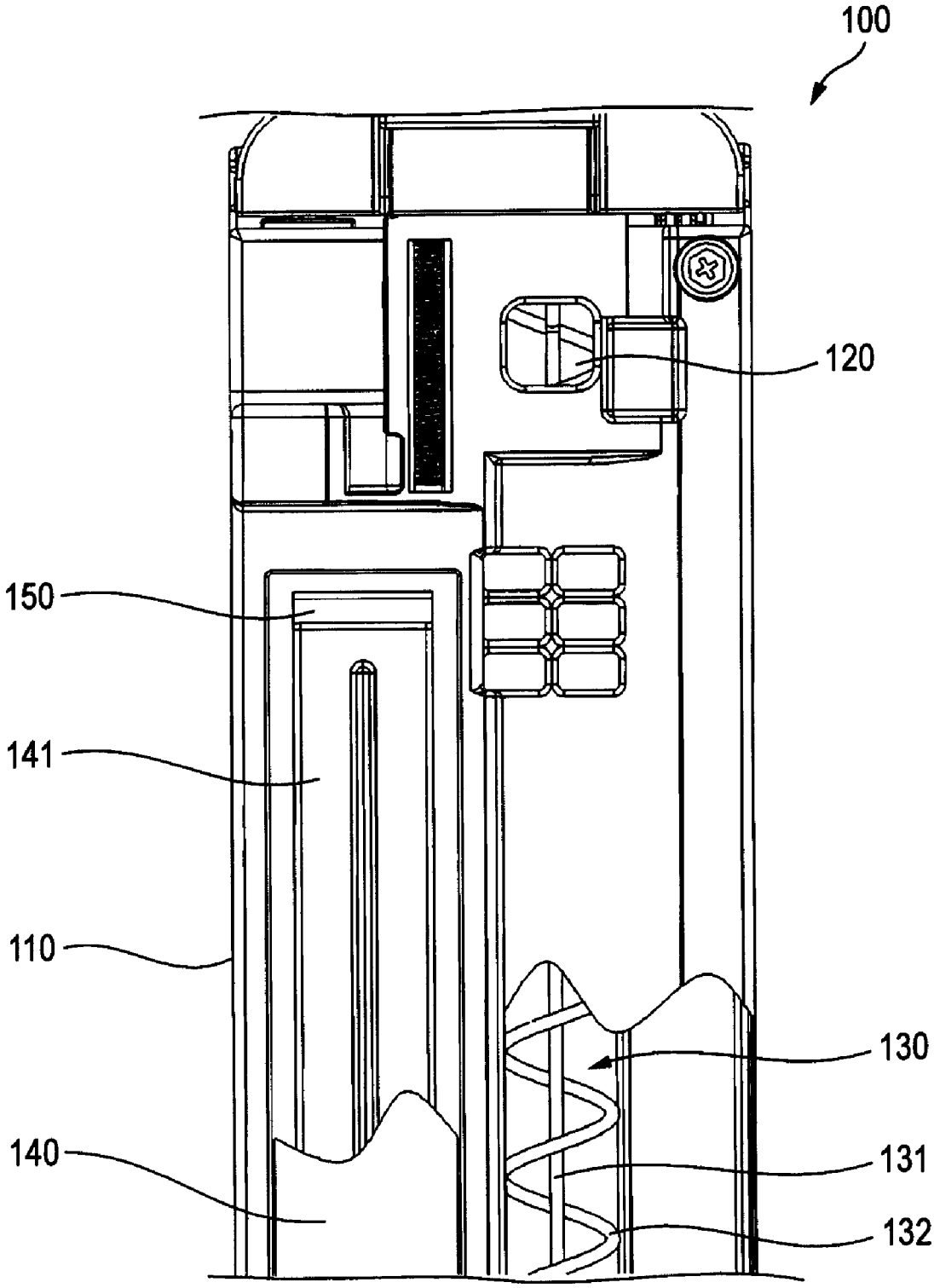
FIG. 4 is a top plan view illustrating position relationship between the air inlet and the collecting opening.

The air inlet 150 is disposed in the vicinity of the collecting opening 120, in the upper end portion of the partition wall 141 in the conveying direction of the waste developer conveyed by the conveying means 130. FIG. 4 is a top plan view illustrating position relationship between the air inlet and the collecting opening. With such a configuration, the air entering through the collecting opening 120 into the collecting box 110 mostly flows toward not the conveying means 130 but the air inlet 150, passes between the partition wall 141 and the filter 140 through the air inlet 150, and is ejected from the filter 140 to the outside.

That is, in the waste developer collecting device 100 of the embodiment, a conveying path of the waste developer is formed on the position biased to one side of the collecting box 110, and an air flow path is formed on the position biased to the other side thereof. Thus, the waste developer does not directly flow to the filter 140, and it is possible to effectively prevent contamination of the filter 140.

Specifically, when the waste developer and the air enters into the collecting box 110 through the collecting opening 120, the waste developer is dropped from the collecting opening 120 to the conveying means 130 under the hole by gravity, and the air flows toward not the conveying means 130 but the air inlet 150. Thereby, it is possible to separate the waste developer and the air, and it may be configured that the waste developer does not directly flow to the filter 140.

In addition, the waste developer is conveyed one after another by the conveying means 130 and is collected in a part of the collecting box 110 on the downstream side in the conveying direction, and some waste developer may flow to the left side in which the filter 140 exists in the drawings. However, the waste developer does not directly reach the filter 140 by the partition wall 141 facing to the filter 140, and so enters only into the air inlet 150 which is located opposite to the conveying side. Accordingly, it is possible to elongate the path of the waste developer flowing up to the filter 140, and thus the most waste developer is collected in the collecting box 110 while the waste developer flows along the path. Hence, it is possible to make the waste developer flowing up to the filter 140 excessively small and the air inlet 150 is prevented from being blocked even when the waste developer is accumulated.

Here, in the embodiment, a sectional area of the aperture of the air inlet 150 is set larger than a sectional area of the aperture of the collecting opening 120. In addition, an area of the filter 140 is set larger than the sectional area of the aperture of the air inlet 150. With such a configuration, it is possible to effectively pass the air entering from the collecting opening 120 through the air inlet 150, and to discharge the air through the filter 140 to the outside.

Figure 5:
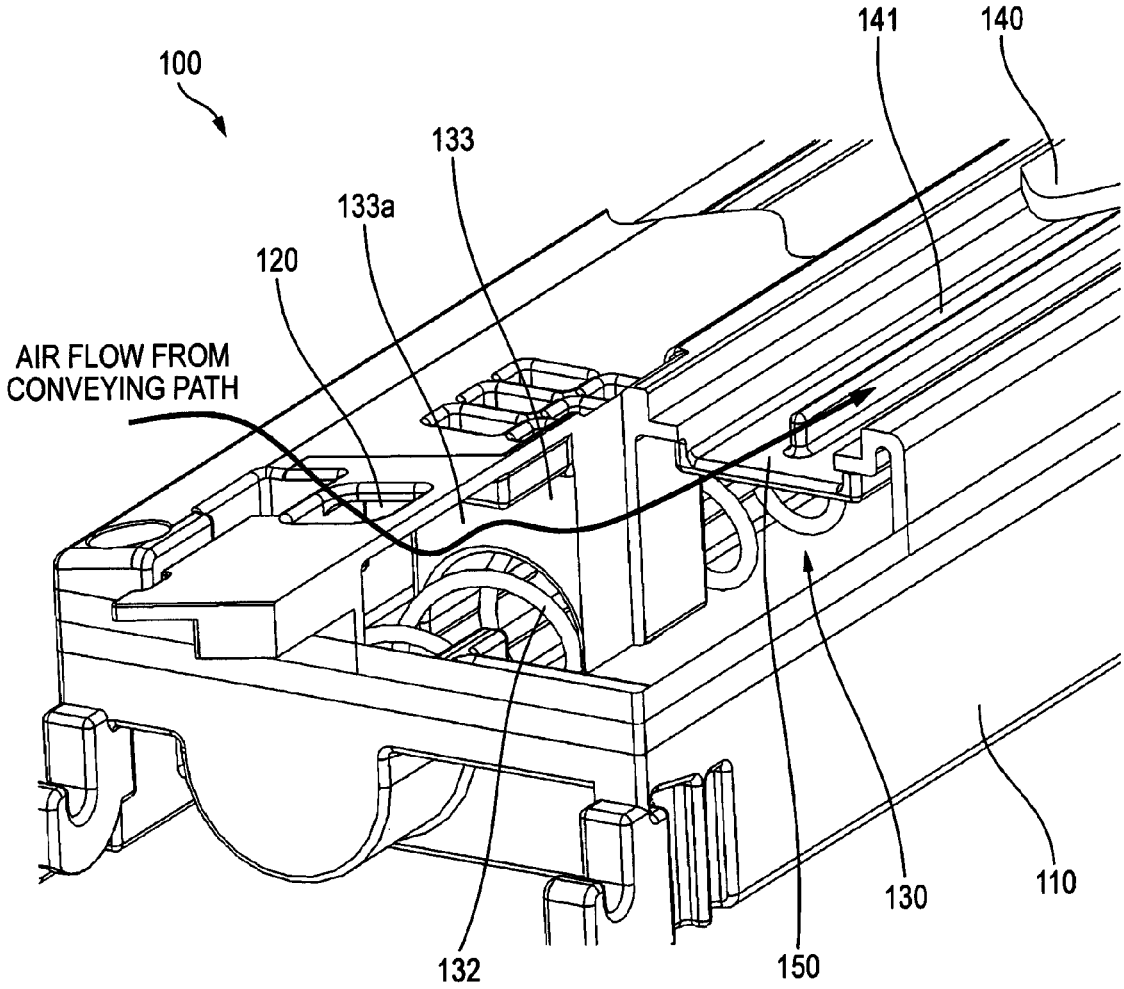
FIG. 5 is a partially cut away perspective view illustrating the holding plate of the conveying means.

In addition, inside the collecting box 110, the holding plate is formed as a guide of the conveying means 130 and as a guide for guiding the air into the air inlet through the collecting opening 120. FIG. 5 is a partially cut away perspective view illustrating the holding plate of the conveying means. The holding plate 133 is formed on the rear surface of an upper cover of the collecting box 110 in a shape including a curved part corresponding to an outward shape of the coil 132 of the conveying means 130. The curved part of the holding plate 133 surrounds the circumference of the coil 132 of the conveying means 130 by closing the upper cover, and thus serves as a guide for suppressing core vibration generated when the coil 132 of the conveying means 130 is rotated. An individual holding plate (see FIG. 3) is also formed on the front end side of the coil 132, and core vibration of the coil 132 is certainly suppressed by the holding plates.

In addition, the holding plate 133 is disposed between the collecting opening 120 and the air inlet 150, and a wall surface 133*a* of the holding plate 133 serves as a guide for guiding the air flow. Specifically, the air entering through the collecting opening 120 flows along the wall surface 133*a* of the holding plate 133, and is guided into the air inlet 150.

On the other hand, the waste developer entering through the collecting opening 120 is blocked by the wall surface 133*a* of the holding plate 133, is dropped down by gravity, and thus is guided into the conveying means 130. As described above, by employing the holding plate 133, it is possible to completely separate the waste developer and the air entering through the collecting opening 120.

In addition, in the embodiment, the air inlet 150 is disposed higher than the collecting opening 120. Specifically, in a state where the image forming apparatus is equipped with the waste developer collecting device 100, the air inlet 150 is set higher than the collecting opening 120. With such a configuration, the air entering through the collecting opening 120 flows to the air inlet 150, and can be discharged through the filter 140 to the outside. On the other hand, the waste developer is hard to be raised up to the air inlet 150 higher than the collecting opening 120, and so is effectively dropped down to the conveying means 130.

Figure 6:
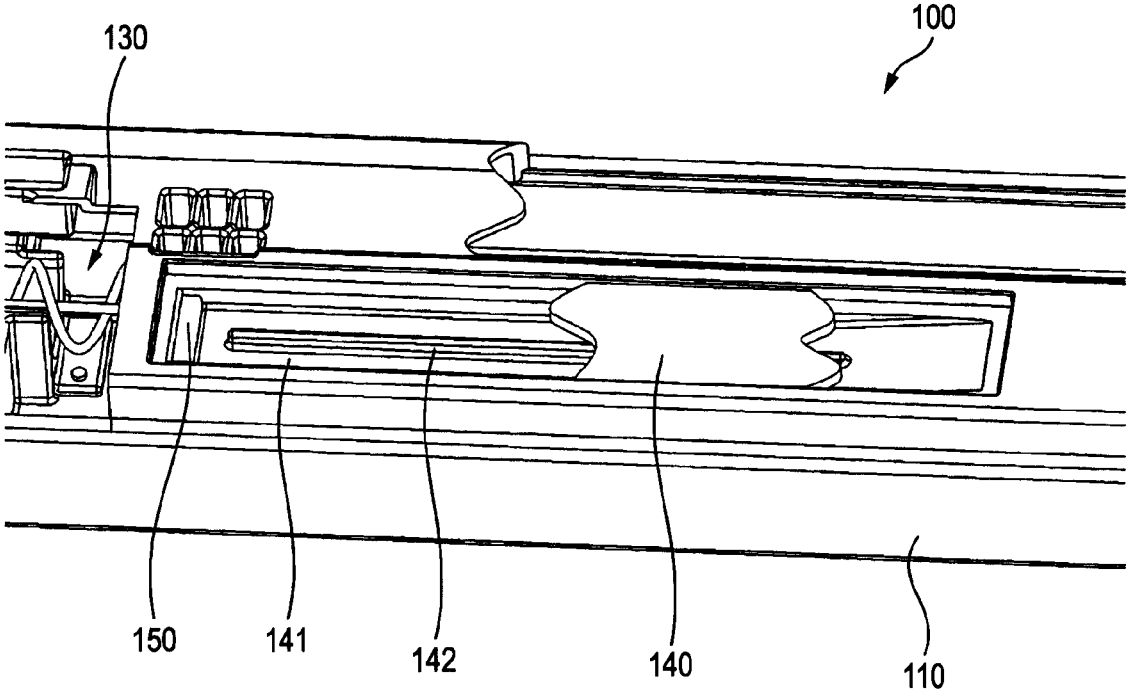
FIG. 6 is a perspective view illustrating a rib of a filter attachment part.

FIG. 6 is a perspective view illustrating a rib of a filter attachment part. Specifically, the filter 140 is attached to cover the aperture in the upper surface of the collecting box 110, and the partition wall 141 is formed to face to the filter 140. In this case, a rib 142 having a predetermined height is formed on the substantially center of the partition wall 141 along the lengthwise direction of the filter 140. Since the rib 142 is formed on the substantially center of the partition wall 141, the center part of the filter 140 is supported by the rib 142 even when being pressed by some reason, and thus it is possible to prevent damage of the filter 140. In addition, the interspace is formed between the rib 142 and the filter 140, and is configured not to obstruct air flow even when the rib 142 is employed.

Figure 7:
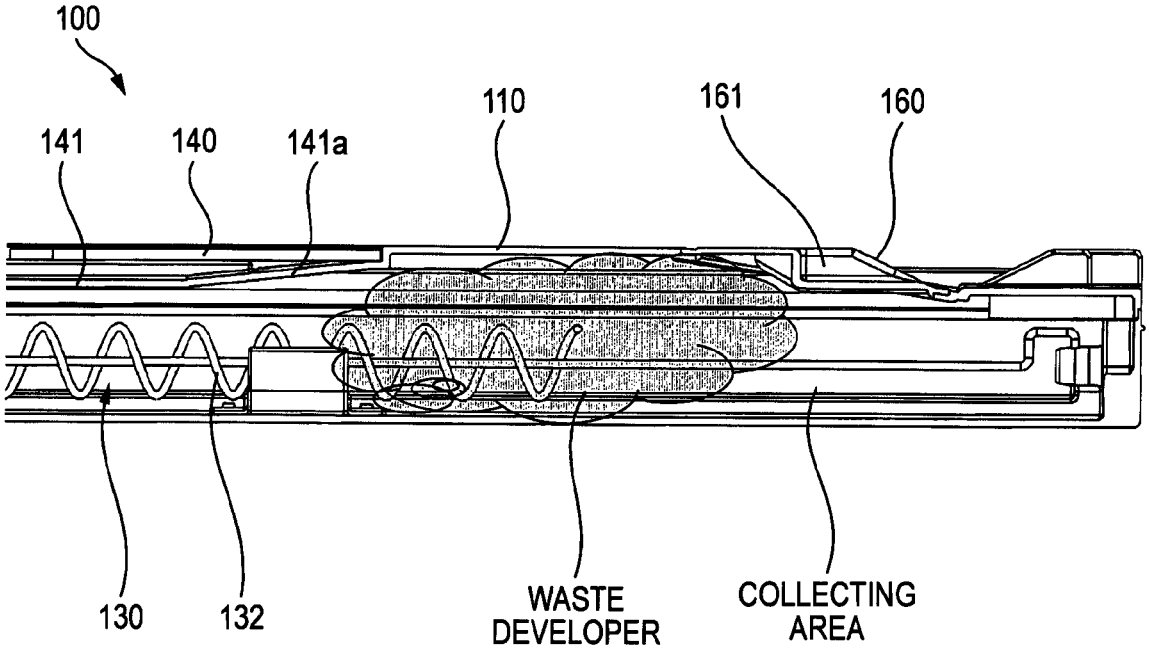
FIG. 7 is a schematic sectional view illustrating an internal structure of the collecting box.
Figure 8:
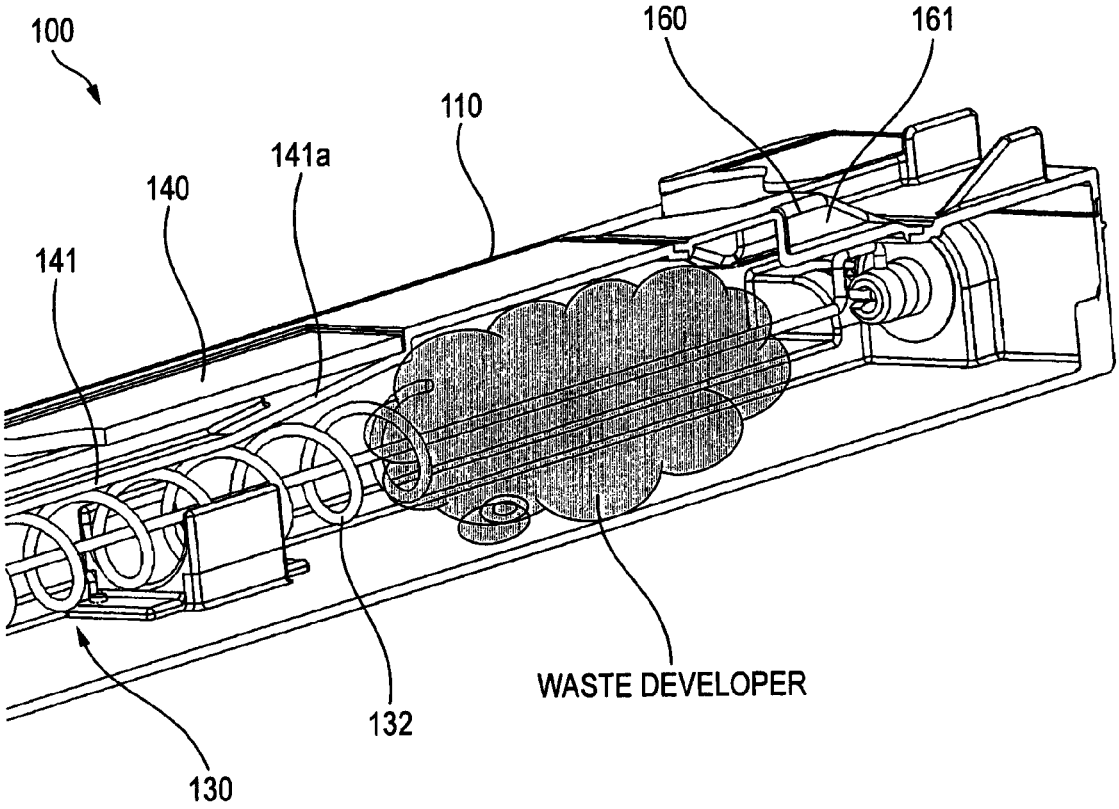
FIG. 8 is a schematic perspective view illustrating the internal structure of the collecting box.

FIG. 7 is a schematic sectional view illustrating an internal structure of the collecting box. FIG. 8 is a schematic perspective view illustrating the internal structure of the collecting box. In the waste developer collecting device 100 of the embodiment, an inclined part 141*a* is formed on an end portion of the partition wall 141 to face to the filter 140 of the collecting box 110. The inclined part 141*a* is inclined to direct the flow of the waste developer which is collected while being radially spread from the terminal end of the coil 132 in the conveying means 130. Specifically, by employing the inclined part 141*a*, it is possible to effectively collect the waste developer without any level difference blocking the flow of the waste developer that radially flows from the terminal end of the coil 132 in the conveying means 130.

In addition, a detection window 160 is formed on the collecting area of the waste developer in the collecting box 110. The detection window 160 is disposed on the downstream side in a conveying direction than the terminal end of the coil 132 of the conveying means 130, and has longitudinal wall surfaces 161 that are transparent to light generated from an optical sensor and are formed on the upper surface of the collecting box 110.

Specifically, the detection window 160 has the longitudinal wall surfaces 161 formed on both of side openings of steps in the center portion, and is made of a transparent material. When light is transmitted from the one side opening to the other side opening of the center portion of the detection window 160, it is detected whether light is transmitted therethrough or not, and thus it is detected whether the waste developer is full or not. Specifically, when the waste developer does not exist in the convex portion which is located at the center of the detection window 160, the light emitted from the optical sensor is transmitted through the longitudinal wall surfaces 161, and thus it is possible to know that the waste developer can be still further collected in the collecting box 110. Conversely, the waste developer is gradually collected in the collecting area of the collecting box 110, reaches the position of the detection window 160, and flows into the convex portion of the center of the detection window 160. In this case, the light emitted from the optical sensor is not transmitted through the longitudinal wall surfaces 161 and is blocked, and thus it is possible to detect the state (a full state) where the waste developer can not be further collected in the collecting box 110.

The detection window 160 is disposed on a position biased to the filter 140 in the upper surface of the collecting box 110. In addition, the detection window 160 is disposed higher than the lower surface of the partition wall facing to the filter 140.

Here, the steps formed on both of the side openings of the center portion of the detection window 160 makes difference in level of the inner surface of the collecting box 110, and thus is the reason why the flow of the waste developer is obstructed. Therefore, in the embodiment, an inclined portion is formed on the step parts of the detection window 160 in the collecting box 110, and thus the flow of the waste developer is not obstructed.

Figure 9:
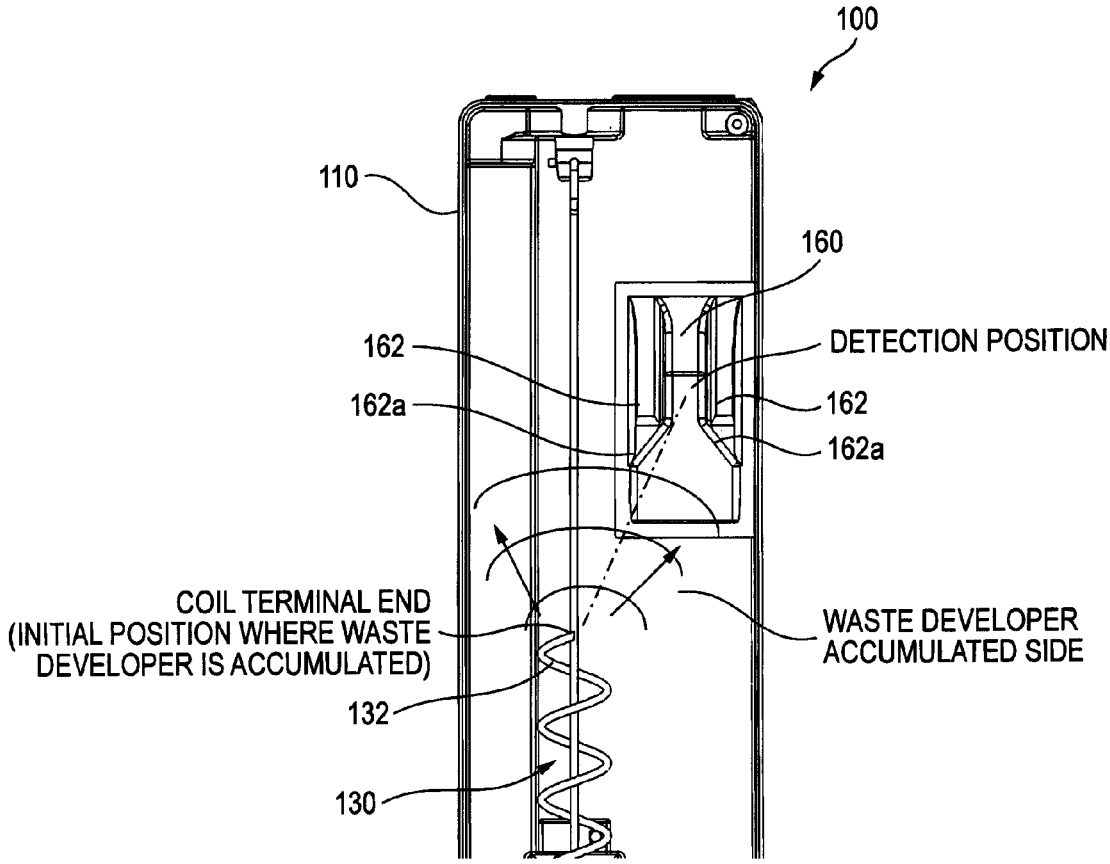
FIG. 9 is a schematic view illustrating an inner part shape of the collecting box in the detection window.

FIG. 9 is a schematic view illustrating an inner part shape of the collecting box in the detection window. FIG. 9 is a view illustrating an inner side of the upper surface of the collecting box 110 as viewed from the rear side. In the step parts 162 of the detection window 160, a guide 162*a* is formed along the waste developer inflow direction.

Figure 10:
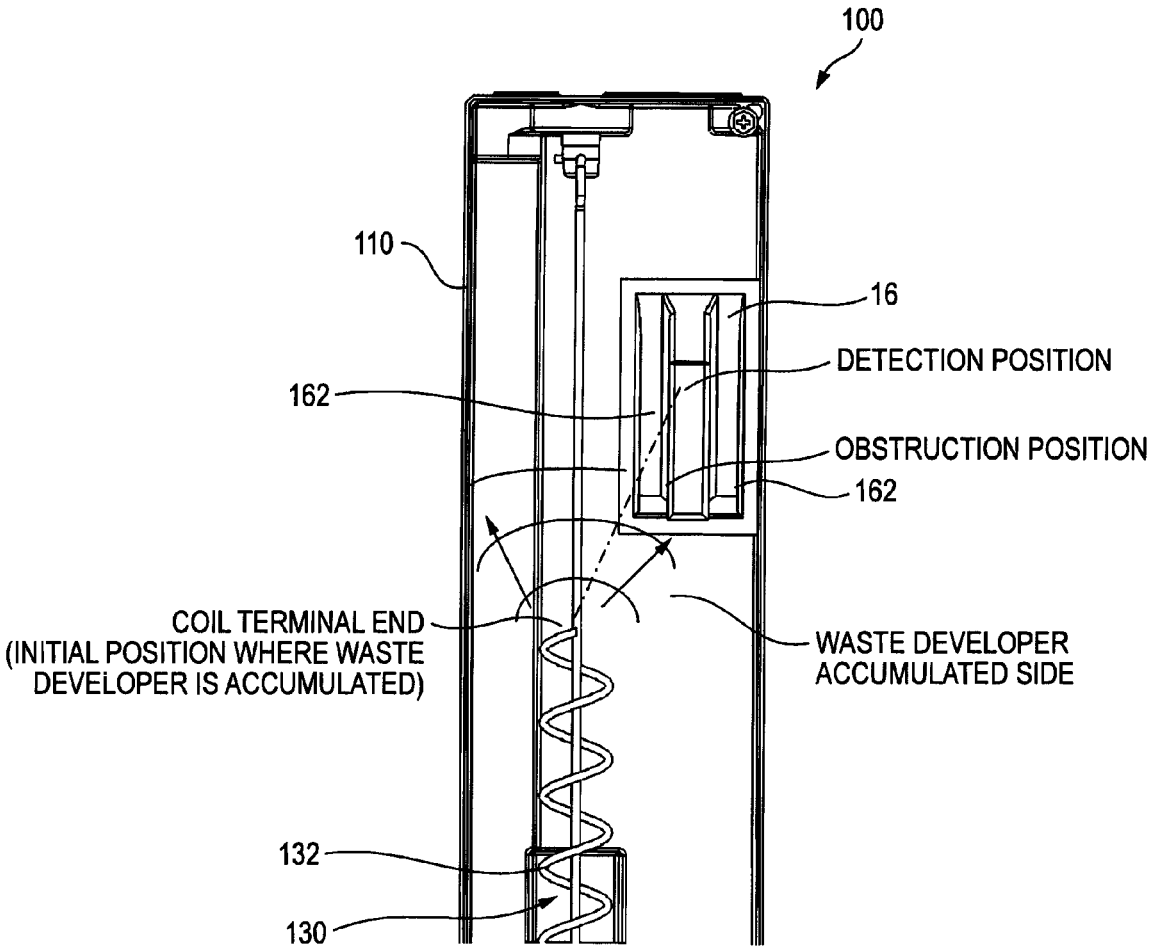
FIG. 10 is a schematic view illustrating a flow of the waste developer in a case where a guide is not employed in the detection window.

FIG. 10 is a schematic view illustrating a flow of the waste developer in a case where a guide is not employed in the detection window. As described above, if the entrance of the detection window 160 including the step parts 162 is formed as a perpendicular wall surface, the flow of the waste developer is obstructed by the entrance when the waste developer flows in the detection window 160. Hence, when the waste developer flows in detection window 160, soft blocking occurs in the vicinity of the detection window 160. Thus, the waste developer does not smoothly flow in the detection window 160, and so it is difficult to detect whether the waste developer is full.

Conversely, in the shape of the detection window 160 of the embodiment shown in FIG. 9, the step parts 162 of the detection window 160 are inclined toward the upstream side in the conveying direction of the waste developer. Thus, the step parts 162 are formed not to be on the line from the terminal end of the coil 132 of the conveying means 130 to the detection position of the detection window 160. Accordingly, when the waste developer flows toward the detection window 160, the flow of the waste developer is not obstructed by the step parts 162, and the waste developer smoothly flows along the guide 162*a*. Thus, it is possible to precisely detect whether the waste developer is full.

Figure 11:
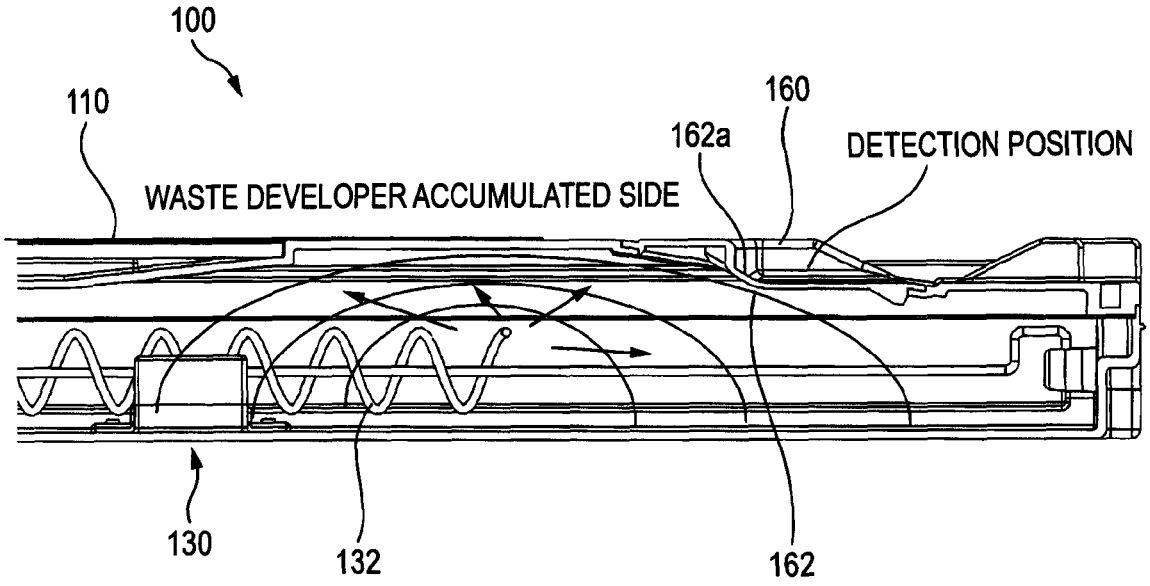
FIG. 11 is a schematic sectional view illustrating a flow of the waste developer in the waste developer collecting device according to the embodiment.
Figure 12:
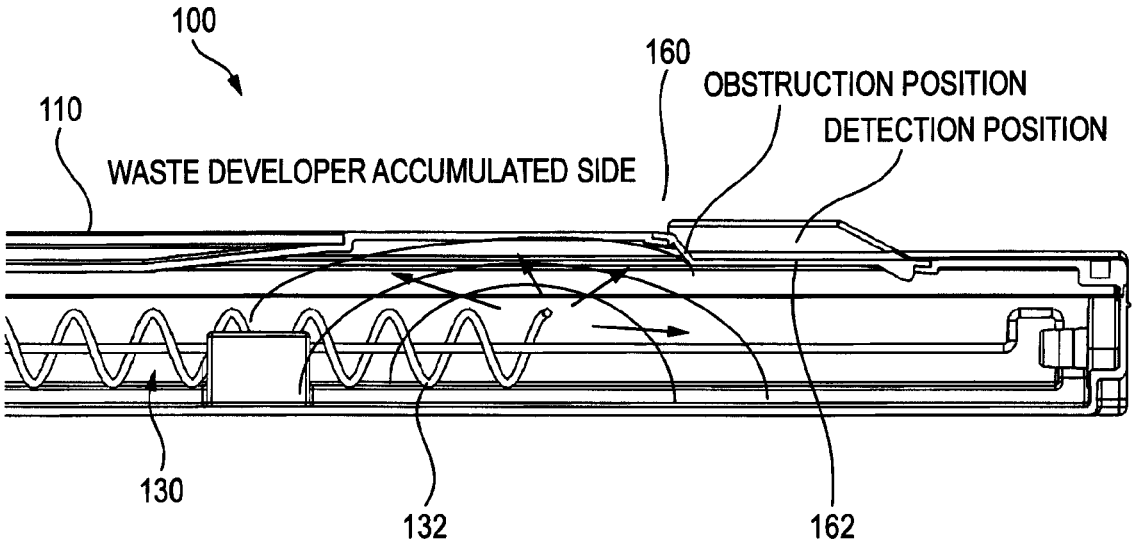
FIG. 12 is a schematic view illustrating a flow of a waste developer in a conventional waste developer collecting device.

FIG. 11 is a schematic sectional view illustrating a flow of the waste developer in the waste developer collecting device according to the embodiment. FIG. 12 is a schematic view illustrating a flow of a waste developer in a conventional waste developer collecting device. The drawings show the flow of the waste developer described above in a transverse direction.

As shown in FIG. 12, in the conventional waste developer collecting device 100, when the waste developer radially flowing from the terminal end of the coil 132 of the conveying means 130 reaches the detection window 160, the flow of the waste developer is obstructed by the step parts 162 of the detection window 160.

Meanwhile, as shown in FIG. 11, in the waste developer collecting device 100 of the embodiment, the guide 162*a* is formed in the step part 162. Thus, when the waste developer radially flowing from the terminal end of the coil 132 of the conveying means 130 reaches the detection window 160, the flow of the waste developer is not obstructed by the step parts 162 of the detection window 160, and is guided along the guide 162*a*. With such a configuration, the waste developer is not accumulated at the step parts 162, and thus it is possible to precisely detect whether the waste developer is full by using the detection window 160.

In the embodiment, by using the inclined part 141*a* formed in the end portion of the partition wall 141 facing to the filter 140 described above and the guide 162*a* formed on the step part 162 of the detection window 160, it is possible to collect the waste developer in the collecting area without obstructing the flow of the waste developer radially flowing from the terminal end of the coil 132. Thus, it is possible to effectively collect the waste developer in the collecting box 110 and it is also possible to precisely detect whether the waste developer is full by using the detection window 160.

Figure 13A:
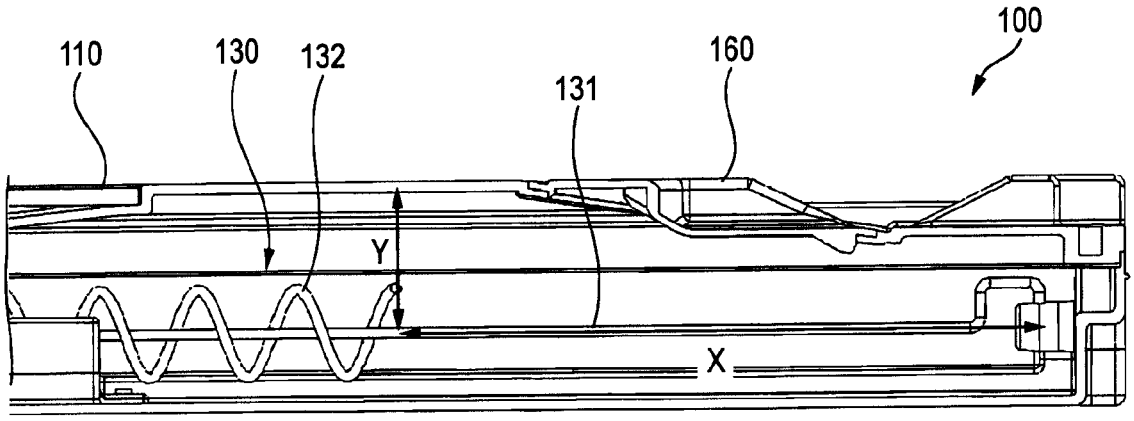
FIGS. 13A and 13B are schematic views illustrating a size of the collecting box.
Figure 13B:
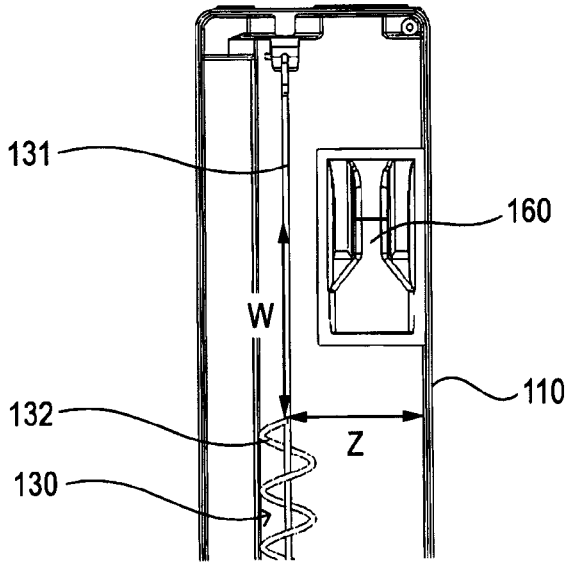

FIG. 13 is a schematic view illustrating a size of the collecting box, where FIG. 13(*a*) is a sectional view, and FIG. 13(*b*) is a rear side view of the upper part of the collecting box. In the waste developer collecting device 100, the waste developer is sent frontward one after another by the coil 132 of the conveying means 130 formed in the collecting box 110, and thus the waste developer is collected while being radially spread from the terminal end of the coil 132.

In this case, by making the waste developer flow into the detection window 160, it is detected whether the collecting box 110 is full. However, because of the positional relationship between the detection window 160 and the terminal end of the coil 132 of the conveying means 130, problems may arise in that location where the waste developer is scarcely accumulated occurs or the conveying means 130 in the collecting box 110 can not be rotated by torque increase and the like before the waste developer flows into the detection window 160.

Accordingly, in the embodiment, the size of the collecting box 110 is prescribed as follows. X is a distance from the terminal end of the coil 132 of the conveying means 130 in the collecting box 110 to the end portion of the collecting box 110 in the direction of the shaft 131. Y is a distance from the terminal end of the coil 132 of the conveying means 130 to the upper end of the collecting box 110, in the section orthogonal to the shaft 131 of the conveying means 130 in the collecting box 110. Z is a distance from the terminal end of the coil 132 of the conveying means 130 to the side end of the collecting box 110, in the section orthogonal to the shaft 131 of the conveying means 130 in the collecting box 110. W is a distance from the terminal end of the coil 132 of the conveying means 130 in the collecting box 110 to the detection position of the detection window 160 in the direction of the shaft 131. In this case, Y, Z, and W are in the range of 40% to 60% of X.

As the terminal end of the coil 132 of the conveying means 130 is viewed in the direction of the shaft 131, the conveyed waste developer is gradually collected while being radially spread from the terminal end of the coil 132 in the collecting box 110. Hence, when the detection position of the detection window 160 is unnecessarily far from the terminal end of the coil 132, the waste developer flows to the side surface, the upper surface, or the lower surface of the collecting box 110 before reaching the detection position of the detection window 160. Thus, although the waste developer is fully collected, the state may not be detected in the detection window 160.

Conversely, when the detection position of the detection window 160 is unnecessarily close to the terminal end of the coil 132, the waste developer reaches the detection window 160 before sufficiently being collected in the collecting area. Thus, although the waste developer can be still further collected, it is erroneously detected that the waste developer is full.

Accordingly, by prescribing the size relation among X, Y, Z, and W as described above, it is possible to precisely detect that the waste developer is full when the waste developer is sufficiently collected in the collecting box 110. Thus, it is possible to effectively collect the waste developer in the collecting box 110 and to detect that the waste developer is full.

In addition, in the embodiment, the exemplary case where the detection window 160 is formed on the upper surface of the collecting box 110 has been described, but the detection window 160 may be formed on the side surface of the collecting box 110 as the need arise. In addition, the detection window 160 may be disposed on an extended line of the shaft 131 of the conveying means 130.

Figure 14:
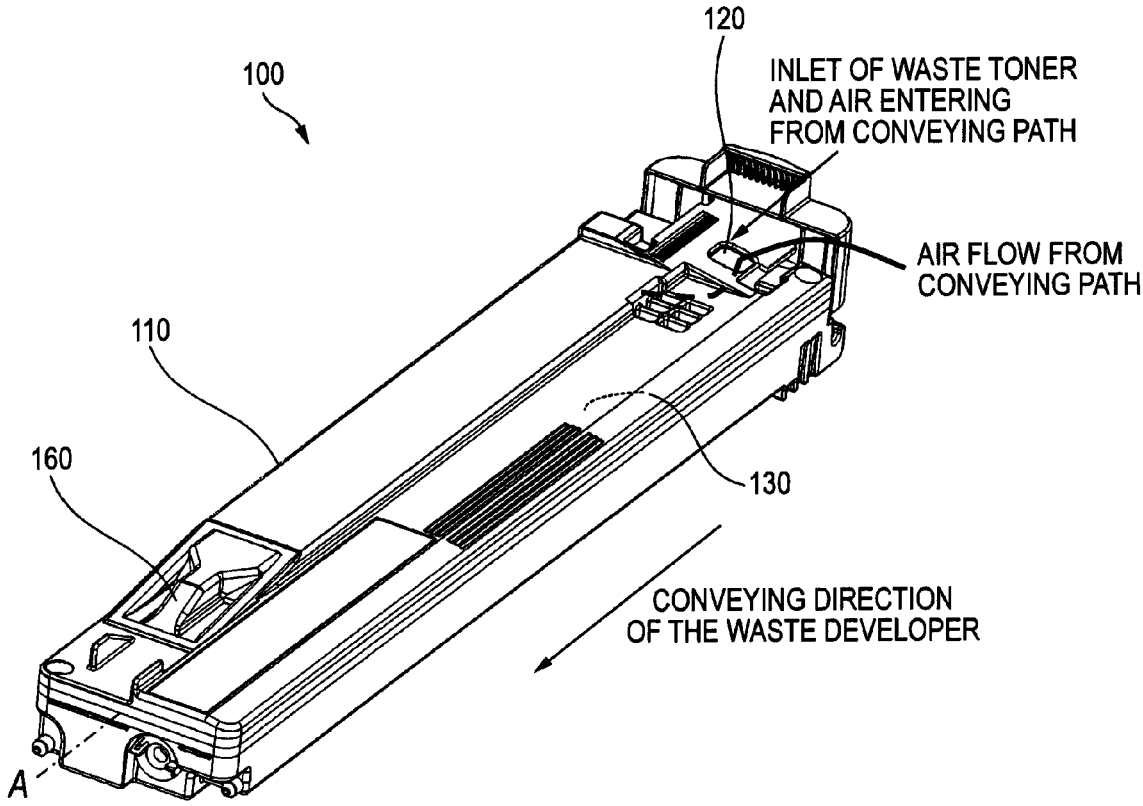
FIG. 14 is a perspective view illustrating another example of the waste developer collecting device according to the embodiment.

FIG. 14 is a perspective view illustrating another example of the waste developer collecting device according to the embodiment. Specifically, the waste developer collecting device 100 includes the collecting box 110 for collecting the waste developer, the collecting opening 120 serving as the inlet for the waste developer and air formed on the upper surface of the collecting box 110, the conveying means 130 for conveying frontward the waste developer entering through the collecting opening 120 one after another in the collecting box 110, and the detection window 160 formed in the collecting area of the waste developer in the collecting box 110.

Figure 15:
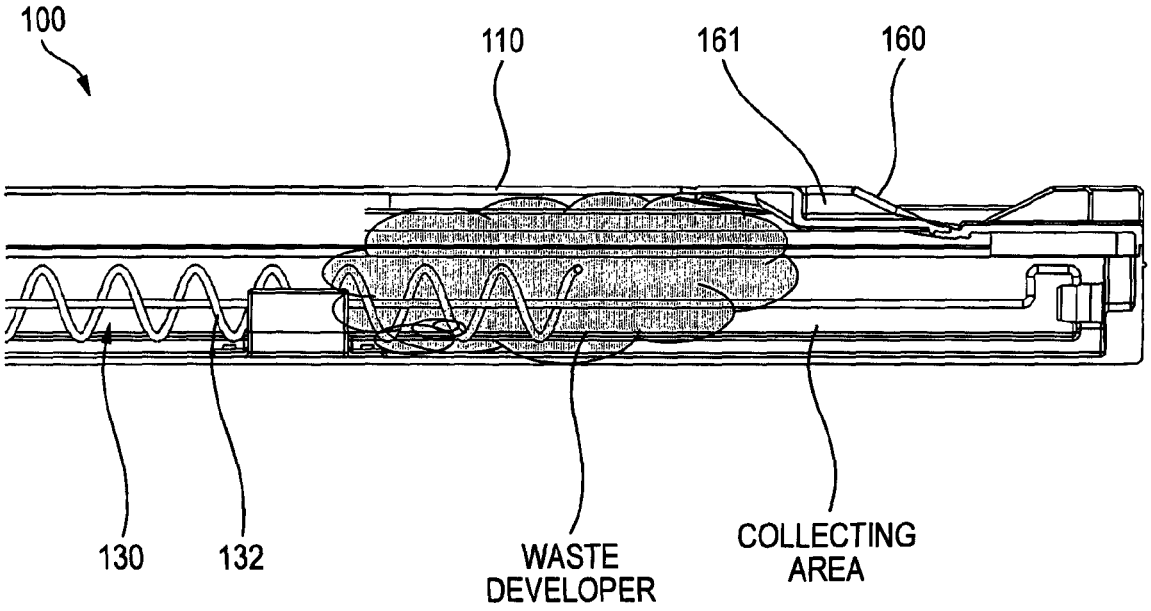
FIG. 15 is a schematic perspective view illustrating the internal structure of the collecting box.

The detection window 160 is disposed on the downstream side in a conveying direction than the terminal end of the coil 132 of the conveying means 130, and has longitudinal wall surfaces 161 that are transparent to light generated from an optical sensor and are formed on the upper surface of the collecting box 110 as shown in FIG. 15.

Specifically, the detection window 160 has the longitudinal wall surfaces 161 formed on both of side openings of steps in the center portion, and is made of a transparent material. When light is transmitted from the one side opening to the other side opening of the center portion of the detection window 160, it is detected whether light is transmitted therethrough or not, and thus it is detected whether the waste developer is full or not. Specifically, when the waste developer does not exist in the convex portion which is located at the center of the detection window 160, the light emitted from the optical sensor is transmitted through the longitudinal wall surfaces 161, and thus it is possible to know that the waste developer can be still further collected in the collecting box 110. Conversely, the waste developer is gradually collected in the collecting area of the collecting box 110, reaches the position of the detection window 160, and flows into the convex portion of the center of the detection window 160. In this case, the light emitted from the optical sensor is not transmitted through the longitudinal wall surfaces 161 and is blocked, and thus it is possible to detect the state (a full state) where the waste developer can not be further collected in the collecting box 110.

Here, the steps formed on both of the side openings of the center portion of the detection window 160 makes difference in level of the inner surface of the collecting box 110, and thus is the reason why the flow of the waste developer is obstructed. Therefore, in the embodiment, an inclined portion is formed on the step parts of the detection window 160 in the collecting box 110, and thus the flow of the waste developer is not obstructed.

In addition, the step parts 162 (see FIG. 9) of the detection window 160 are inclined toward the upstream side in the conveying direction of the waste developer. Thus, the step parts 162 are formed not to be on the line from the terminal end of the coil 132 of the conveying means 130 to the detection position of the detection window 160. Accordingly, when the waste developer flows toward the detection window 160, the flow of the waste developer is not obstructed by the step parts 162, and the waste developer smoothly flows along the guide 162*a*. Thus, it is possible to precisely detect whether the waste developer is full.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A waste developer collecting device comprising:

a collecting container that collects a waste developer discharged from image forming unit including a developing unit for developing an electrostatic latent image with a developer;

a collecting opening that is disposed on an inner wall surface of the collecting container, and collects the waste developer and air discharged from the developing unit;

a conveying unit that is disposed in the collecting container, rotates about a shaft, and conveys the waste developer entering through the collecting opening in the collecting container;

a filter that passes the air collected in the collecting container through the collecting opening, and blocks the waste developer;

a partition wall that partitions an inside of the collecting container into the filter and a containing area for containing the waste developer; and an air inlet that is formed in an end portion of the partition wall on an upstream side in a conveying direction of the waste developer conveyed by the conveying unit, and that sends the air entering into the collecting container to the filter along the partition wall.

2. The waste developer collecting device as claimed in claim 1, wherein the air inlet includes an aperture having a sectional area being larger than a sectional area of an aperture of the collecting opening.

3. The waste developer collecting device as claimed in claim 1, wherein the filter has an area being larger than a sectional area of an aperture of the air inlet.

4. The waste developer collecting device as claimed in claim 1, wherein the air inlet is formed at a position being different from a position corresponding to the collecting opening and the conveying unit.

5. The waste developer collecting device as claimed in claim 1, wherein the collecting container includes a holding plate provided therein, the holding plate guides the conveying unit, and guides into the air inlet the air entering into the collecting container through the collecting opening.

6. The waste developer collecting device as claimed in claim 1, wherein the air inlet is formed in the vicinity of the collecting opening.

7. The waste developer collecting device as claimed in claim 1, wherein the partition wall is inclined so as to prevent obstructing a flow of the waste developer at the time when the waste developer is collected in a collecting area inside the collecting container.

8. The waste developer collecting device as claimed in claim 1, further comprising:

a rib that is formed between the partition wall and the filter; and an interspace that is formed between the rib and the filter in a case where the filter is attached to the collecting box.

9. The waste developer collecting device as claimed in claim 1, further comprising:

a detection window that is formed in a part of the collecting container on a downstream side in the conveying direction of the waste developer conveyed by the conveying unit, and wherein the detection window has a height being larger than a height of a lower surface of the partition wall.

10. The waste developer collecting device as claimed in claim 1, further comprising:

a detection window that is formed at a position being different from a center of an upper surface of the collecting container toward the air inlet, in a part of the collecting container on a downstream side in the conveying direction of the waste developer conveyed by the conveying unit.

11. The waste developer collecting device as claimed in claim 1, wherein the air inlet is disposed higher than the collecting opening.

12. The waste developer collecting device as claimed in claim 1, wherein the conveying unit includes a coil rotating about the shaft.

13. An image forming apparatus comprising:

a waste developer collecting device that collects a waste developer discharged from image forming unit including a developing unit for developing an electrostatic latent image with a developer, wherein the waste developer collecting device includes:

a collecting container that collects the waste developer;

a collecting opening that is disposed on an inner wall surface of the collecting container to collect the waste developer and air discharged from the developing unit;

a conveying unit that is disposed in the collecting container, rotates about a shaft, and conveys the waste developer entering through the collecting opening in the collecting container;

a filter that passes the air collected in the collecting container through the collecting opening, and blocks the waste developer;

a partition wall that partitions an inside of the collecting container into the filter and a containing area for containing the waste developer; and an air inlet that is formed in an end portion of the partition wall on an upstream side in a conveying direction of the waste developer conveyed by the conveying unit to send the air entering into the collecting container to the filter along the partition wall.

* * * * *